US011727866B2

(12) United States Patent
Kim

(10) Patent No.: US 11,727,866 B2
(45) Date of Patent: Aug. 15, 2023

(54) POWER MANAGEMENT DEVICE AND DISPLAY DEVICE INCLUDING THE SAME

(71) Applicant: LX Semicon Co., Ltd., Daejeon (KR)

(72) Inventor: Sung Ha Kim, Daejeon (KR)

(73) Assignee: LX SEMICON CO., LTD., Daejeon (KR)

( * ) Notice: Subject to any disclaimer, the term of this patent is extended or adjusted under 35 U.S.C. 154(b) by 0 days.

(21) Appl. No.: 17/556,228

(22) Filed: Dec. 20, 2021

(65) Prior Publication Data

US 2022/0199005 A1 Jun. 23, 2022

(30) Foreign Application Priority Data

Dec. 21, 2020 (KR) ..... 10-2020-0179564

(51) Int. Cl.
*G09G 3/3208* (2016.01)
*G09G 3/3225* (2016.01)

(52) U.S. Cl.
CPC ..... *G09G 3/3208* (2013.01); *G09G 3/3225* (2013.01); *G09G 2320/0276* (2013.01); *G09G 2320/0673* (2013.01); *G09G 2330/021* (2013.01); *G09G 2340/0435* (2013.01)

(58) Field of Classification Search
CPC ..... G09G 3/3208; G09G 3/3225; G09G 2320/0276; G09G 2320/0673; G09G 2330/021; G09G 2340/0435; G09G 2310/061; G09G 2330/00
See application file for complete search history.

(56) References Cited

U.S. PATENT DOCUMENTS

| | | | | |
|---|---|---|---|---|
| 7,173,377 | B2 * | 2/2007 | Park | G09G 3/3225 345/82 |
| 7,839,370 | B2 * | 11/2010 | Izumikawa | G09G 3/3648 345/55 |
| 7,977,931 | B2 * | 7/2011 | Wadhwa | G05F 1/565 323/314 |
| 9,324,261 | B2 * | 4/2016 | Lee | G09G 3/3208 |
| 9,818,364 | B2 * | 11/2017 | Lee | G09G 3/3648 |
| 9,892,670 | B2 * | 2/2018 | Seo | G09G 3/20 |
| 9,934,750 | B2 * | 4/2018 | Park | G09G 3/3688 |
| 10,593,290 | B2 * | 3/2020 | Yamada | G02F 1/1368 |
| 10,777,112 | B2 * | 9/2020 | Heo | G09G 3/2092 |
| 10,871,819 | B2 * | 12/2020 | Ma | G06F 1/3265 |
| 11,062,649 | B2 * | 7/2021 | Kim | G09G 3/3275 |
| 11,464,099 | B2 * | 10/2022 | Bonne | G09G 3/32 |
| 11,482,150 | B2 * | 10/2022 | Kim | G09G 3/20 |
| 11,501,730 | B2 * | 11/2022 | Park | G09G 3/3688 |
| 2005/0258772 | A1 * | 11/2005 | Park | G09G 3/3225 315/169.1 |

(Continued)

FOREIGN PATENT DOCUMENTS

| | | |
|---|---|---|
| KR | 10-1476880 B1 | 12/2014 |
| KR | 10-2016-0119355 A | 10/2016 |

*Primary Examiner* — Michael J Jansen, II
(74) *Attorney, Agent, or Firm* — Rothwell, Figg, Ernst & Manbeck, P.C.

(57) ABSTRACT

The present disclosure relates to a power management device and a display device comprising the same, and more particularly, to a power management device and a display device comprising the same, capable of reducing the power consumption of a display device by disabling a gamma reference voltage generation circuit when the display device is driven at a low scan rate.

9 Claims, 5 Drawing Sheets

(56) References Cited

U.S. PATENT DOCUMENTS

| | | | | |
|---|---|---|---|---|
| 2006/0092114 | A1* | 5/2006 | Izumikawa | G09G 3/3648 345/89 |
| 2009/0237040 | A1* | 9/2009 | Wadhwa | G05F 1/565 323/234 |
| 2011/0080433 | A1* | 4/2011 | Park | G09G 3/3233 345/212 |
| 2013/0082910 | A1* | 4/2013 | Lee | G09G 3/3208 345/76 |
| 2015/0243204 | A1* | 8/2015 | Park | G09G 3/3688 345/212 |
| 2016/0063914 | A1* | 3/2016 | Lee | G09G 3/3688 345/211 |
| 2016/0293106 | A1* | 10/2016 | Seo | G09G 3/20 |
| 2017/0076648 | A1* | 3/2017 | Lan | G09G 3/3696 |
| 2018/0277057 | A1* | 9/2018 | Yamada | G09G 3/2011 |
| 2019/0107883 | A1* | 4/2019 | Ma | G06F 1/3265 |
| 2020/0013321 | A1* | 1/2020 | Imai | G02F 1/133305 |
| 2020/0098297 | A1* | 3/2020 | Heo | G09G 3/20 |
| 2020/0211457 | A1* | 7/2020 | Kim | G09G 3/3233 |
| 2021/0251066 | A1* | 8/2021 | Bonne | H05B 47/18 |
| 2021/0350735 | A1* | 11/2021 | Kim | G09G 3/3611 |
| 2022/0139349 | A1* | 5/2022 | Park | G09G 3/3688 345/87 |
| 2022/0199005 | A1* | 6/2022 | Kim | G09G 3/3225 |

* cited by examiner

POWER MANAGEMENT DEVICE AND DISPLAY DEVICE INCLUDING THE SAME

CROSS REFERENCE TO RELATED APPLICATION

This application claims priority from Korean Patent Application No. 10-2020-0179564, filed on Dec. 21, 2020, which is hereby incorporated by reference for all purposes as if fully set forth herein.

BACKGROUND

1. Technical Field

Various embodiments generally relate to a power management device and a display device including the same.

2. Related Art

One of the most important issues in electronic appliances including mobile appliances is to minimize power consumption. As the capacity of a battery is limited and an electronic appliance is miniaturized, power consumption also needs to be continuously reduced. Thus, research on the reduction of power consumption is being conducted more actively. In displays mounted on almost all electronic appliances, there will be ample room for the reduction of power consumption.

A power management device known as a power management integrated circuit (PMIC) supplies power, required to drive a display inside an electronic appliance, to respective devices such as a panel, a data driving device, a gate driving device and so forth. Recently, as the number of display devices which are not constantly supplied with power (e.g., a mobile communication device, a notebook computer device, etc.) increases, research for minimizing the power consumption of such power management device is being conducted.

In this regard, various embodiments intend to provide a technique for reducing power consumption by partially reducing or blocking the supply of power while a display device operates.

SUMMARY

Under such a background, in one aspect, the present disclosure is to provide a technique of reducing the power consumption of a display device by disabling a gamma reference voltage generation circuit when the display device is driven at a low scan rate.

In one aspect, the present disclosure provides a power management device comprising: a gamma reference voltage generation circuit configured to output a gamma reference voltage during an active period of one frame, and to stop output of the gamma reference voltage and to cause an output terminal of the gamma reference voltage to be in a high impedance state during a vertical blank period of the one frame; and a control circuit configured to control the gamma reference voltage generation circuit to output the gamma reference voltage during the vertical active period and to control the gamma reference voltage generation circuit to stop output of the gamma reference voltage and to control the output terminal be in the high impedance state, during the vertical blank period.

In another aspect, the present disclosure provides a display device comprising: a power management device comprising a gamma reference voltage generation circuit configured to output a gamma reference voltage during an active period of one frame and to stop output of the gamma reference voltage and to cause an output terminal of the gamma reference voltage to be in a high impedance state during a vertical blank period of the one frame, and a control circuit configured to control the gamma reference voltage generation circuit to output the gamma reference voltage during the vertical active period and to control the gamma reference voltage generation circuit to stop output of the gamma reference voltage and to control the output terminal to be in the high impedance state during the vertical blank period; and a gamma voltage generation device configured to be enabled and to receive the gamma reference voltage from the power management device during the active period and to be disabled during the vertical blank period.

As is apparent from the above description, according to the embodiments, when a display device is driven at a low scan rate, a power management device may disable a gamma reference voltage generation circuit during each vertical blank period of each frame, which makes it possible to reduce the power consumption of the display device.

DETAILED DESCRIPTION

Figure 1:
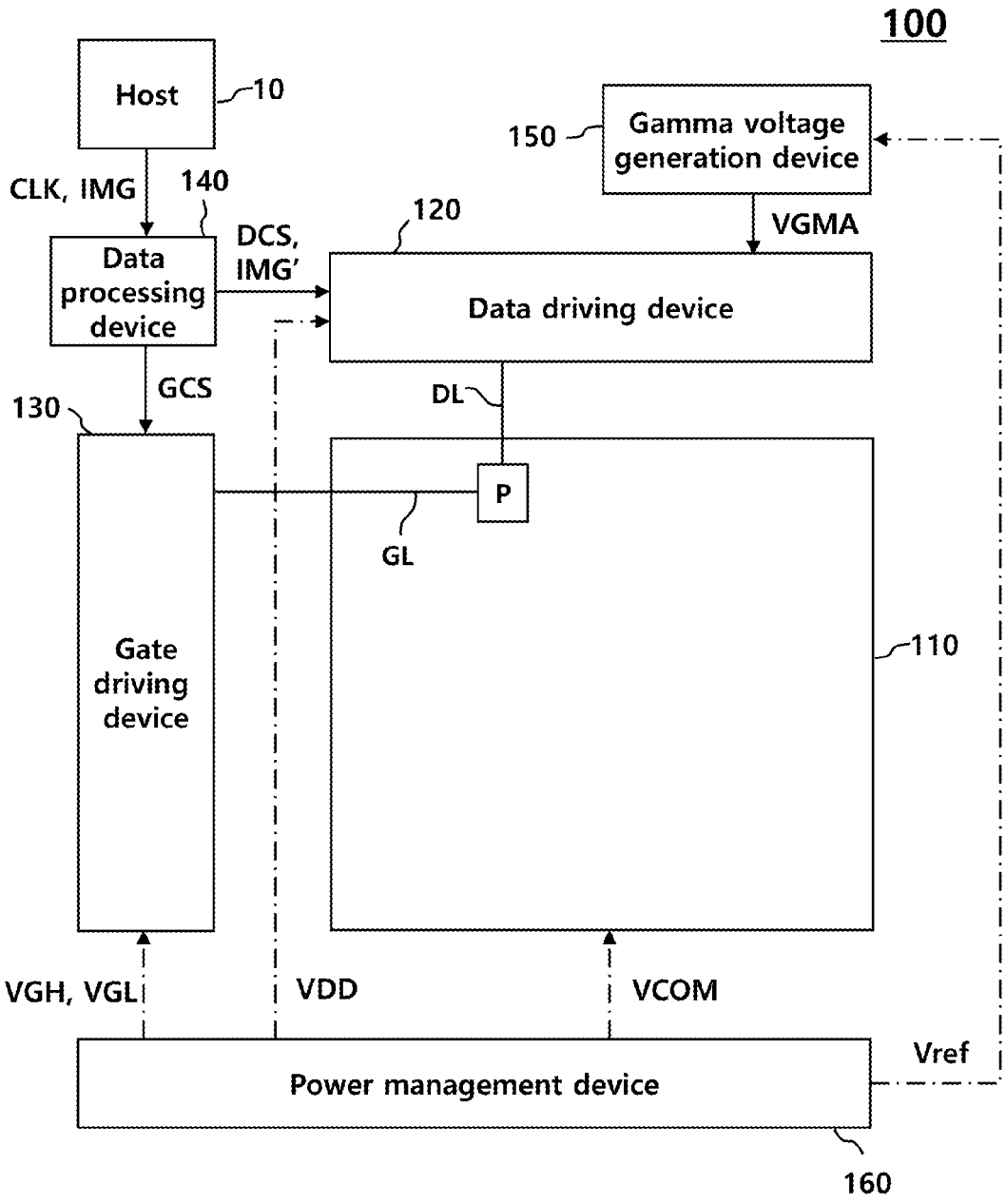
FIG. 1 is a configuration diagram of a display device in accordance with an embodiment.

FIG. 1 is a configuration diagram of a display device in accordance with an embodiment.

Referring to FIG. 1, a display device 100 may include a display panel 110, a data driving device 120, a gate driving device 130, a data processing device 140, a gamma voltage generation device 150 and a power management device 160.

At least one of the data driving device 120, the gate driving device 130, the data processing device 140, the gamma voltage generation device 150 and the power management device 160 may be included in one integrated circuit (IC). Such an integrated circuit may be referred to as a display driver integrated circuit (DDI).

Such a display driver integrated circuit may receive image data IMG from a host 10 and process the image data IMG according to an internal data format. The display driver integrated circuit may supply a data voltage, corresponding to processed image data IMG', to the display panel 110.

A plurality of data lines DL and a plurality of gate lines GL may be disposed in the display panel 110. Further, a plurality of pixels P may be disposed in the display panel 110. The plurality of pixels P may be disposed adjacent to one another in the horizontal direction and the vertical direction of the display panel 110 to represent a rectangular shape. The rectangular shape is similar to a matrix. A set of a plurality of pixels P arranged in the horizontal direction may be defined as a pixel row or a horizontal line, and a set of a plurality of pixels P arranged in the vertical direction may be defined as a pixel column or a vertical line.

Each pixel P may include an organic light-emitting diode (OLED) and at least one transistor. The at least one transistor may include a low-temperature polycrystalline oxide (LTPO) transistor.

The gate driving device 130 may supply a scan signal having a turn-on voltage or a turn-off voltage to a gate line GL. When the scan signal having a turn-on voltage is supplied to a pixel P, the corresponding pixel P is connected to a data line DL, and when the scan signal having a turn-off voltage is supplied to a pixel P, the connection between the corresponding pixel P and a data line DL is released.

The data driving device 120 receives the image data IMG' from the data processing device 140, generates a data voltage corresponding to the image data IMG', and supplies the data voltage to the data line DL. The data voltage supplied to the data line DL is transferred to the pixel P which is connected to the data line DL depending on the scan signal.

In other words, the data driving device 120 may generate a data voltage corresponding to the image data IMG' and output the data voltage to the display panel 110. The image data IMG' may include a plurality of frame data.

The data processing device 140 may supply various control signals to the gate driving device 130 and the data driving device 120. The data processing device 140 may generate a gate control signal GCS which causes a scan to be started according to a timing implemented in each frame, and may transmit the gate control signal GCS to the gate driving device 130. The data processing device 140 may convert the image data IMG, inputted from the host 10, into the image data IMG' to match a data format used in the data driving device 120.

The data processing device 140 may transmit the image data IMG' to the data driving device 120. The data processing device 140 may transmit a data control signal DCS which controls the data driving device 120 to supply a data voltage to each pixel P according to each timing. The data processing device 140 may generate the gate control signal GCS and the data control signal DCS using a clock signal CLK received from the host 10.

The gamma voltage generation device 150 generates a plurality of gamma voltages VGMA required when the data driving device 120 generates a data voltage, and outputs the gamma voltages VGMA to the data driving device 120. While FIG. 1 illustrates that the gamma voltage generation device 150 is separated from the data driving device 120, the embodiment is not limited thereto, and the gamma voltage generation device 150 may be included in the data driving device 120. In this case, the data driving device 120 may be divided into a data driving block which supplies a data voltage to the data line DL and a gamma block which generates the plurality of gamma voltages VGMA.

The power management device 160 may generate voltages (powers) to be supplied to respective components in the display device 100, and may output the voltages (powers) to the respective components in the display device 100. For example, the power management device 160 may generate a common electrode voltage VCOM and output the common electrode voltage VCOM to the display panel 110. Further, the power management device 160 may generate a gate low voltage VGL and a gate high voltage VGH and output the gate low voltage VGL and the gate high voltage VGH to the gate driving device 130, and may generate a driving voltage VDD and output the driving voltage VDD to the data driving device 120.

Also, the power management device 160 may generate a gamma reference voltage Vref and output the gamma reference voltage Vref to the gamma voltage generation device 150. The gamma reference voltage Vref may include a first reference voltage and a second reference voltage, and the first reference voltage may be higher than the second reference voltage.

Meanwhile, in an embodiment, the display device 100 may be driven at a high scan rate of 60 HZ (Hertz) or more when displaying a moving image, and may be driven at a low scan rate of 10 HZ or less when displaying a still image.

In an embodiment, between a vertical active period and a vertical blank period during which one frame data is displayed on the display panel 110, that is, between a vertical active period and a vertical blank period of one frame, the vertical blank period may be longer when the display device 100 is driven at a low scan rate than when the display device 100 is driven at a high scan rate.

During the vertical active period, the data driving device 120 may generate a data voltage corresponding to one frame data and output the data voltage to the display panel 110.

During the vertical blank period, the data driving device 120 may disable components which generate and output a data voltage, and the gamma voltage generation device 150 may also be disabled.

In other words, during the vertical active period, the data driving device 120 may generate and output a data voltage by enabling all components, and during the vertical blank period, the data driving device 120 may consume less power by disabling components which generate and output a data voltage.

Similarly, the gamma voltage generation device 150 may also be enabled during the vertical active period to receive the gamma reference voltage Vref from the power management device 160, and may output the plurality of gamma voltages VGMA by using the gamma reference voltage Vref.

The gamma voltage generation device 150 may be disabled during the vertical blank period. Through this, the power consumption of the display device 100 may be reduced.

Because the gamma voltage generation device 150 is disabled during the vertical blank period as described above, if, among components of the power management device 160, a component which generates the gamma reference voltage Vref may be disabled, the power consumption of the display device 100 may be further reduced.

To this end, in an embodiment, the component which generates the gamma reference voltage Vref, among the components of the power management device 160, may be disabled through the following configuration.

Figure 2:
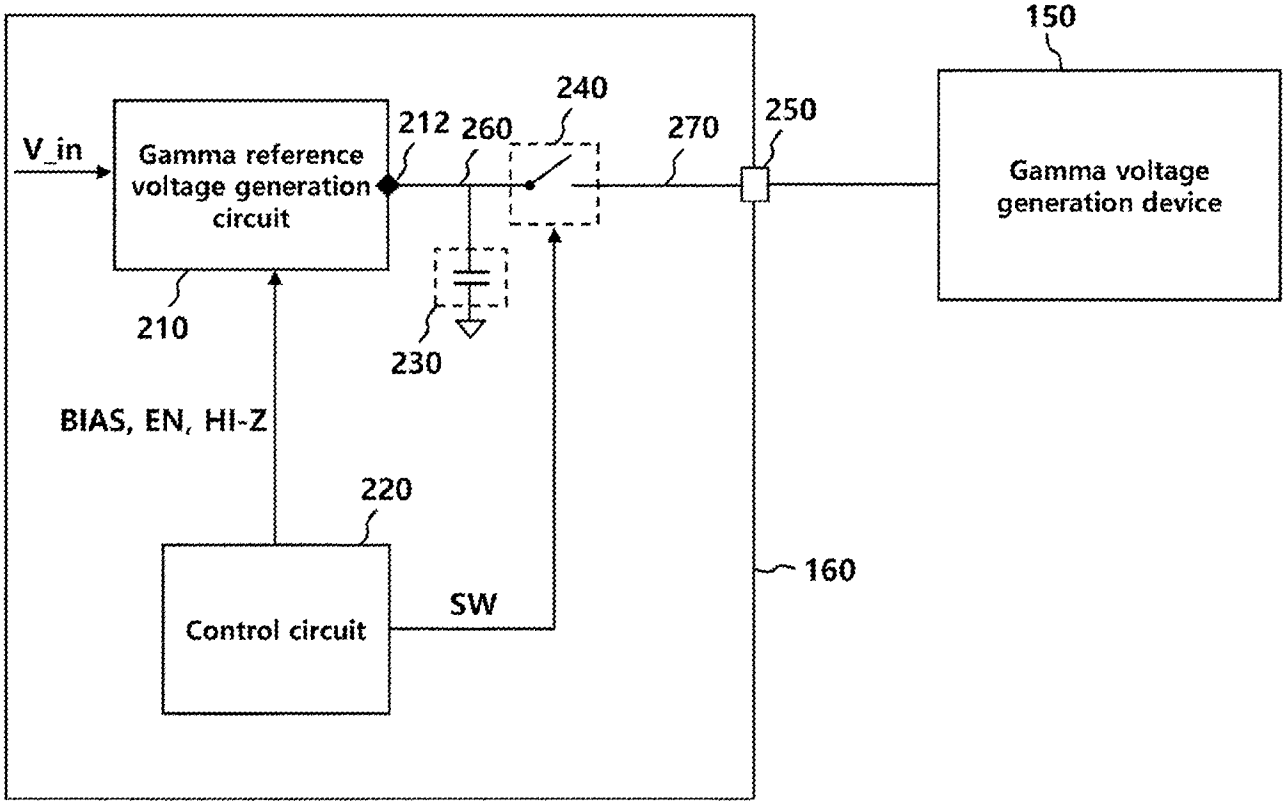
FIG. 2 is a configuration diagram of a power management device in accordance with an embodiment.

FIG. 2 is a configuration diagram of a power management device in accordance with an embodiment.

Referring to FIG. 2, the power management device 160 may include a gamma reference voltage generation circuit 210, a control circuit 220 and an external capacitor 230, and may further include an output-side switch circuit 240, an output pad 250, a first internal line 260 and a second internal line 270.

Figure 4:
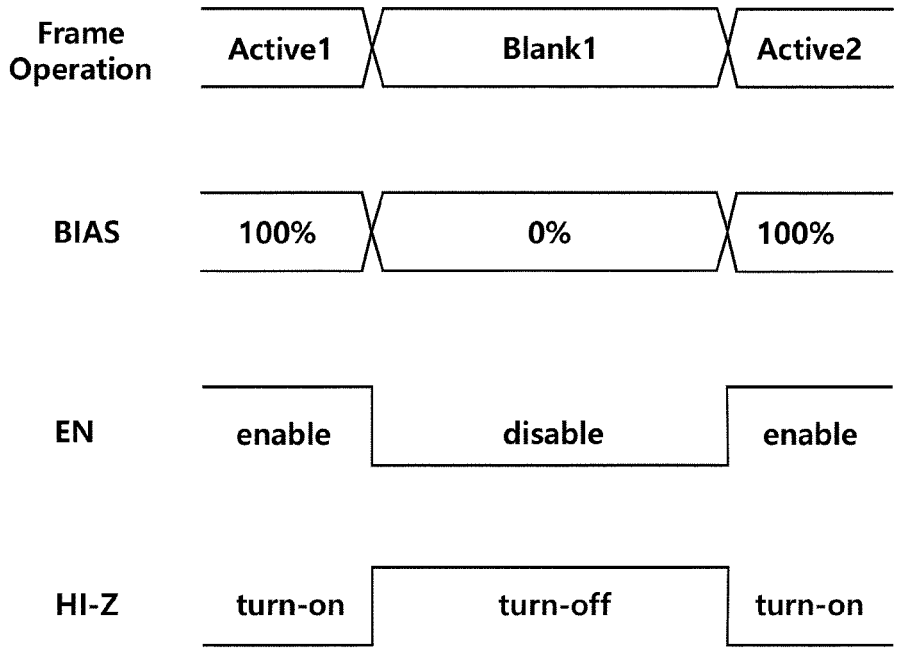
FIGS. 4 and 5 are diagrams to assist in the explanation of the operation of the power management device in accordance with the embodiment.

As illustrated in FIG. 4, the gamma reference voltage generation circuit 210 may output a gamma reference voltage during a vertical active period Active1 of one frame, and may stop the output of the gamma reference voltage during a vertical blank period Blank1 of the one frame. The vertical active period Active1 and the vertical blank period Blank1 may be a vertical active period and a vertical blank period when the display device 100 is driven at a low scan rate of 10 HZ or less. When the display device 100 is driven at a low scan rate of 10 HZ or less, the vertical blank period may be set to be longer than the vertical active period.

The fact that the gamma reference voltage generation circuit 210 stops the output the gamma reference voltage may mean that the gamma reference voltage generation circuit 210 is disabled.

An output terminal 212 of the gamma reference voltage generally has a low impedance.

If the external capacitor 230 and the output terminal 212 are electrically connected in a state in which the gamma reference voltage generation circuit 210 is disabled, the charge charged in the external capacitor 230 may be introduced into the gamma reference voltage generation circuit 210 through the output terminal 212.

In this case, when the vertical blank period Blank1 of the one frame is switched to a vertical active period Active2 of another frame, more power and time may be consumed to charge the external capacitor 230.

In an embodiment, in order to prevent such a phenomenon, the output terminal 212 of the gamma reference voltage is caused to become a high impedance (Hi-Z) state in a state in which the gamma reference voltage generation circuit 210 is disabled during a vertical blank period.

When the output terminal 212 becomes the high impedance (Hi-Z) state during the vertical blank period Blank1, the output terminal 212 and the external capacitor 230 are electrically insulated, and thus, the charge stored in the external capacitor 230 may be prevented from being introduced into the gamma reference voltage generation circuit 210.

Therefore, when the vertical blank period Blank1 of the one frame is switched to the vertical active period Active2 of another frame, power and time for charging the external capacitor 230 are reduced.

Figure 3:
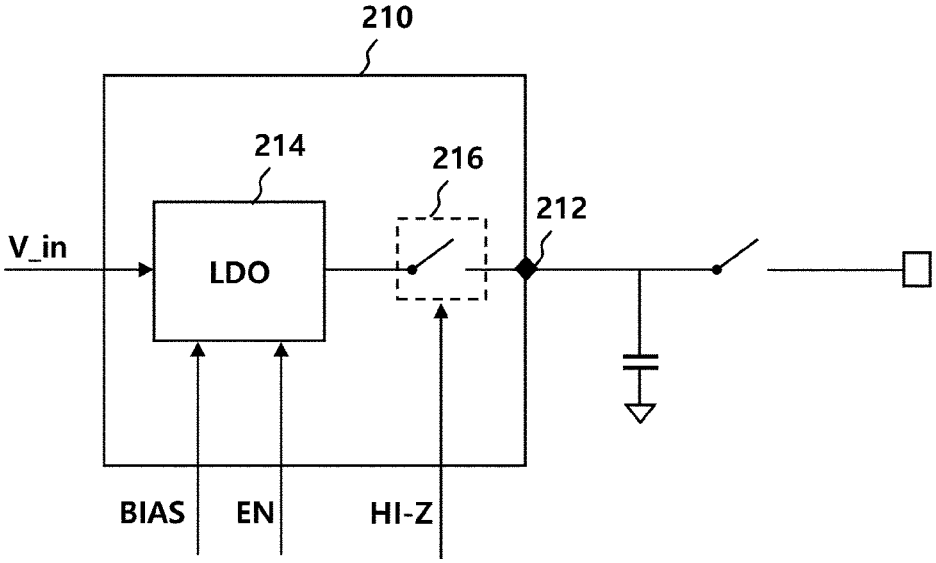
FIG. 3 is a configuration diagram of a gamma reference voltage generation circuit in accordance with an embodiment.

The gamma reference voltage generation circuit 210 may include not only the output terminal 212 but also a low drop-out (LDO) regulator 214 and an internal switch circuit 216 as illustrated in FIG. 3.

The LDO regulator 214 may regulate an input voltage Vin inputted from the outside and output a regulated voltage as the gamma reference voltage.

The internal switch circuit 216 may electrically connect (turn on) or disconnect (turn off) the LDO regulator 214 and the output terminal 212 according to a Hi-Z signal outputted from the control circuit 220 to be described later. When the LDO regulator 214 and the output terminal 212 are electrically disconnected, the output terminal 212 becomes the high impedance state.

The internal switch circuit 216 may include at least one thin film transistor (TFT).

The control circuit 220 controls the gamma reference voltage generation circuit 210 so that the gamma reference voltage generation circuit 210 outputs the gamma reference voltage during a vertical active period of one frame and stops the output of the gamma reference voltage during a vertical blank period of the one frame.

Also, the control circuit 220 controls the output terminal 212 of the gamma reference voltage so that the output terminal 212 becomes a high impedance state.

In detail, during a vertical active period of one frame, the control circuit 220 may output, as illustrated in FIG. 4, an EN signal of a first level for enabling the gamma reference voltage generation circuit 210, to the LDO regulator 214 of the gamma reference voltage generation circuit 210. Further, the control circuit 220 may output a bias current, required when the LDO regulator 214 outputs the gamma reference voltage, to the LDO regulator 214.

When outputting the EN signal of the first level and the bias current to the LDO regulator 214 as described above, the control circuit 220 may output a Hi-Z signal of a second level to the internal switch circuit 216, and thereby, may control the internal switch circuit 216 so that the internal switch circuit 216 electrically connects (turns on) the LDO regulator 214 and the output terminal 212. The first level may be a high potential level, and the second level may be a low potential level compared to the first level.

During the vertical active period, the control circuit 220 may output an SW signal of a first level to the output-side switch circuit 240, and thereby, may control the output-side switch circuit 240 so that the output-side switch circuit 240 electrically connects the gamma reference voltage generation circuit 210 and the gamma voltage generation device 150.

During a vertical blank period of the one frame, the control circuit 220 may output the EN signal of a second level for disabling the gamma reference voltage generation circuit 210, to the LDO regulator 214. At this time, the control circuit 220 may stop the output of the bias current.

When outputting the EN signal of the second level to the LDO regulator 214, the control circuit 220 may output the Hi-Z signal of a first level to the internal switch circuit 216, and thereby, may control the internal switch circuit 216 so that the internal switch circuit 216 electrically disconnects (turns off) the LDO regulator 214 and the output terminal 212.

During the vertical blank period, the control circuit 220 may output the SW signal of a second level to the output-side switch circuit 240, and thereby, may control the output-side switch circuit 240 so that the output-side switch circuit 240 electrically disconnects the gamma reference voltage generation circuit 210 and the gamma voltage generation device 150.

In other words, during the vertical blank period, the power management device 160 and the gamma voltage generation device 150 may be electrically insulated.

When the gamma reference voltage generation circuit 210 and the gamma voltage generation device 150 are electrically disconnected during the vertical blank period, the external capacitor 230 and the gamma voltage generation device 150 are also electrically disconnected, and thus, the charge charged in the external capacitor 230 is not introduced into the gamma voltage generation device 150.

The external capacitor 230 is connected in parallel to the first internal line 260 which is connected to the output terminal 212 of the gamma reference voltage, and thereby, smoothes the gamma reference voltage.

That is to say, the external capacitor 230 may remove a ripple component or a noise component from the gamma reference voltage which is outputted from the gamma reference voltage generation circuit 210.

In an embodiment, the voltage of the external capacitor 230 should be kept constant during the vertical active period and the vertical blank period.

To this end, during the vertical blank period, the output terminal 212 of the gamma reference voltage is caused to become a high impedance state, and thereby, prevents the charge charged in the external capacitor 230 from being introduced into the gamma reference voltage generation circuit 210. Namely, during the vertical blank period, the voltage of the external capacitor 230 is prevented from dropping due to the discharge of the external capacitor 230.

However, due to the general characteristics of the external capacitor 230, a leakage current may flow from the external capacitor 230 during the vertical blank period. In this case, as the charge charged in the external capacitor 230 is discharged, the voltage of the external capacitor 230 may drop.

Figure 5:
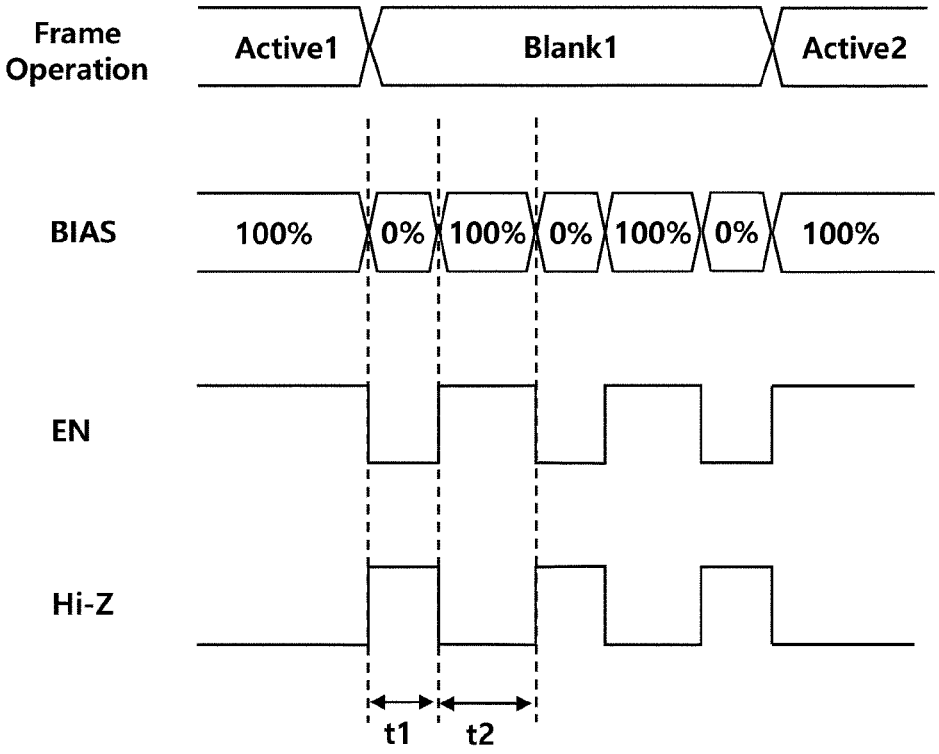

In an embodiment, in order to prevent such a phenomenon, as illustrated in FIG. 5, the control circuit 220 may control the gamma reference voltage generation circuit 210 so that the gamma reference voltage generation circuit 210 intermittently outputs the gamma reference voltage during the vertical blank period. Through this, the voltage of the external capacitor 230 may be kept constant during the vertical blank period.

In detail, during the vertical blank period, the control circuit 220 may output the EN signal of the second level to the LDO regulator 214 during a first time period t1, and may output the Hi-Z signal of the first level to the internal switch circuit 216 during the first time period t1. Through this, the gamma reference voltage generation circuit 210 stops the output of the gamma reference voltage, and the output terminal 212 of the gamma reference voltage becomes a high impedance state. The control circuit 220 may stop the output of the bias current during the first time period t1.

After the first time period t1, the control circuit 220 may output the EN signal of the first level to the LDO regulator 214 during a second time period t2, and may output the Hi-Z signal of the second level to the internal switch circuit 216 during the second time period t2. The control circuit 220 may output the bias current to the LDO regulator 214 during the second time period t2.

Through this, charge is charged in the external capacitor 230 by the gamma reference voltage outputted from the LDO regulator 214. The first time period t1 and the second time period t2 may be set to be different from each other. In detail, the first time period t1 may be set to be shorter than the second time period t2.

As described above, as the control circuit 220 intermittently enables the gamma reference voltage generation circuit 210 during the vertical blank period, a voltage drop of the external capacitor 230 due to the leakage current of the external capacitor 230 may be prevented.

During the first time period t1 and the second time period t2, the control circuit 220 may output the SW signal of the second level to the output-side switch circuit 240, and thereby, may control the output-side switch circuit 240 so that the output-side switch circuit 240 electrically disconnects the gamma reference voltage generation circuit 210 and the gamma voltage generation device 150.

The output-side switch circuit 240 may electrically connect or disconnect the gamma reference voltage generation circuit 210 and the gamma voltage generation device 150 according to the SW signal outputted from the control circuit 220.

The output pad 250 electrically connects the gamma voltage generation device 150 and the second internal line 270.

The first internal line 260 electrically connects the output terminal 212 of the gamma reference voltage and an input terminal of the output-side switch circuit 240.

The second internal line 270 electrically connects an output terminal of the output-side switch circuit 240 and the output pad 250.

As is apparent from the above description, according to the embodiments, when the display device 100 is driven at a low scan rate, the power management device 160 may disable the gamma reference voltage generation circuit 210 during each vertical blank period of each frame, which makes it possible to reduce the power consumption of the display device 100.

What is claimed is:

1. A power management device comprising:

a voltage generation circuit configured to output a reference voltage to a gamma voltage generation device during an active period of one frame, and to stop output of the reference voltage and to cause an output terminal of the reference voltage to be in a high impedance state during a vertical blank period of the one frame;

a control circuit configured to control the voltage generation circuit to output the reference voltage during the active period and to control the voltage generation circuit to stop output of the reference voltage and to control the output terminal to be in the high impedance state during the vertical blank period; and a capacitor connected to an internal line connected to the output terminal and configured to smooth the reference voltage, wherein during the vertical blank period, the control circuit is configured to keep a voltage of the external capacitor constant by controlling the voltage generation circuit to intermittently output the reference voltage, and during the vertical blank period, a first time period, in which the voltage generation circuit is configured to stop output of the reference voltage and the output terminal is in the high impedance state, and a second time period, in which the voltage generation circuit is configured to output the reference voltage, are set to be different from each other.

2. The power management device according to claim 1, wherein the first time period is set to be shorter than the second time period.

3. The power management device according to claim 1, wherein the control circuit outputs a bias current to the voltage generation circuit during the active period and stops output of the bias current during the vertical blank period.

4. The power management device according to claim 1, wherein the voltage generation circuit comprises a low drop-out (LDO) regulator which regulates an input voltage from an external circuit to output the reference voltage.

5. The power management device according to claim 4, wherein the voltage generation circuit further comprises an internal switch to electrically connect the LDO regulator and the output terminal according to control of the control circuit during the active period and to electrically disconnect the LDO regulator and the output terminal from each other during the vertical blank period.

6. The power management device according to claim 4, wherein the vertical blank period is set to be longer than the active period.

7. A display device comprising:

a power management device comprising a voltage generation circuit configured to output a reference voltage during an active period of one frame, and to stop output of the reference voltage and to cause an output terminal of the reference voltage to be in a high impedance state, during a vertical blank period of the one frame, a control circuit configured to control the voltage generation circuit to output the reference voltage during the active period and to control the voltage generation circuit to stop output of the reference voltage and to control the output terminal to be in the high impedance state during the vertical blank period, and a capacitor connected to an internal line connected to the output terminal and configured to smooth the reference voltage; and a gamma voltage generation device configured to be enabled and to receive the reference voltage from the power management device during the active period and to be disabled during the vertical blank period, wherein during the vertical blank period, the control circuit is configured to keep a voltage of the external capacitor constant by controlling the voltage generation circuit to intermittently output the reference voltage, during the vertical blank period, a first time period, in which the voltage generation circuit is configured to stop output of the reference voltage and the output terminal is in the high impedance state, and a second time period, in which the voltage generation circuit is configured to output the reference voltage, are set to be different from each other, and the voltage generation circuit is configured to output the reference voltage to the gamma voltage generation device.

8. The display device according to claim 7, wherein during the vertical blank period the power management device and the gamma voltage generation device are electrically insulated from each other.

9. The display device according to claim 7, wherein the display device is driven at a low scan rate and the vertical blank period is set to be longer than the active period.

* * * * *